United States Patent [19]

Sartor

[11] Patent Number: 4,698,922

[45] Date of Patent: Oct. 13, 1987

[54] SKI BOOT WITH A MECHANISM FOR SECURING A FOOT INSTEP AND HEEL

[75] Inventor: Mariano Sartor, Montebelluna, Italy

[73] Assignee: Nordica S.p.A., Montebelluna, Italy

[21] Appl. No.: 872,339

[22] Filed: Jun. 9, 1986

[30] Foreign Application Priority Data

Jun. 11, 1985 [IT] Italy ..... 22140/85[U]

[51] Int. Cl.[4] ..... A43B 5/04

[52] U.S. Cl. ..... 36/119; 36/117

[58] Field of Search ..... 36/117–121, 36/88.93, 54, 50

[56] References Cited

U.S. PATENT DOCUMENTS

| | | | |
|---|---|---|---|
| 4,160,332 | 7/1979 | Salomon | 36/119 |
| 4,574,500 | 3/1986 | Aldinio et al. | 36/119 |
| 4,577,421 | 3/1986 | Sartor | 36/119 |

FOREIGN PATENT DOCUMENTS

| | | | |
|---|---|---|---|
| 0134778 | 3/1985 | European Pat. Off. | 36/119 |
| 0164625 | 12/1985 | European Pat. Off. | 36/117 |
| 0165525 | 12/1985 | European Pat. Off. | 36/117 |
| 0183182 | 6/1986 | European Pat. Off. | 36/119 |
| 2564711 | 11/1985 | France | 36/119 |

*Primary Examiner*—James Kee Chi

*Attorney, Agent, or Firm*—Guido Modiano; Albert Josif

[57] ABSTRACT

The ski boot comprises a tension element which defines a front section which extends transversely above a foot instep presser and is connected to a rear section, which rearwardly encircles the area of the heel of the foot and is associated with a terminal section which extends transversely above the foot instep presser and is connected fixedly to the inside of the boot.

11 Claims, 1 Drawing Figure

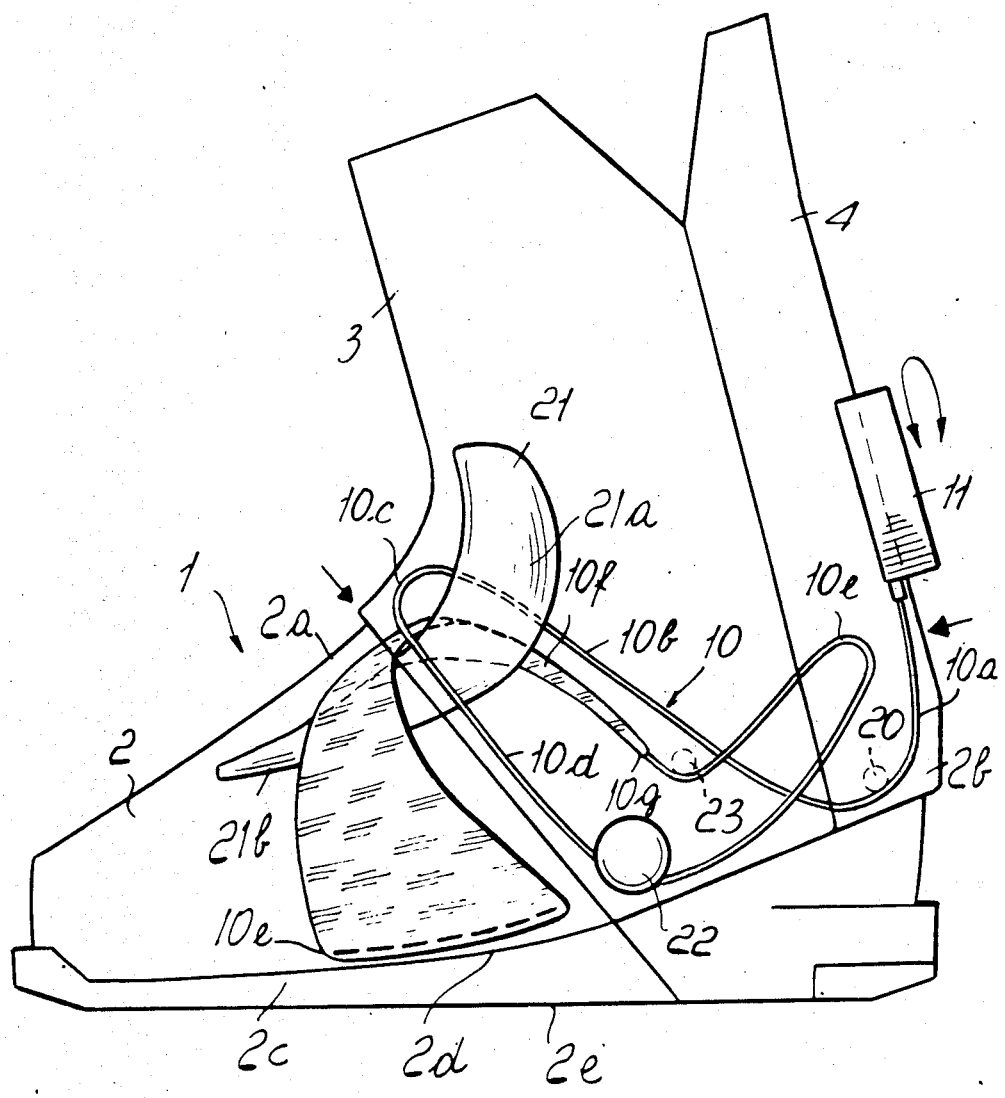
4
3
21
11
10c
21a
1
10f
10e
2a
10b
10
10a
20
2
10d
2b
10g
23
21b
22
10e
2c
2d
2e

SKI BOOT WITH A MECHANISM FOR SECURING A FOOT INSTEP AND HEEL

BACKGROUND OF THE INVENTION

The present invention relates to a ski boot with a mechanism for securing a foot instep and heel.

As is known, in ski boots devices which perform the securing of the foot instep are currently employed; such devices are generally composed of a presser, on which presser, by means of pushing elements, cables or the like, a force is exerted which tends to exert a substantially vertical pressure with respect to the foot instep in order to perform the securing of the foot itself.

With such an embodiment, which is universally adopted, it turns out that the foot is not, in most cases, sufficiently restrained against the lateral movements, so that it is necessary to exert even high pressures in order to obtain an acceptable securing of the foot, with obvious discomfort to the user.

Another disadvantage which can be found in the prior art is furthermore represented by the fact that the securing action exerted on the foot unavoidably tends to shift the foot towards the rear part of the boot, where it is not always possible to create a securing force capable of conveniently securing the foot without causing discomfort to the user.

SUMMARY OF THE INVENTION

The aim of this invention is indeed to obviate the above cited disadvantages by providing a locking device which can act simultaneously on the instep and on the heel of the skier's foot, obtaining a securing action capable of immobilizing the skier's foot, without, however, causing discomfort to the user.

Within the above aim, a particular object of the invention is to provide a mechanism for securing the foot instep and the heel, which is also capable of restraining the foot laterally, thus distributing uniformly on the foot itself the action which can be exerted by means of the presser of the foot instep.

Another object of the present invention is to provide a securing device which, though presenting remarkable functional characteristics, is structurally simple and has a simplified operation.

A not least object of the present invention is to provide a device which can be easily obtained from elements and materials which are commonly available on the market, and which, furthermore, is competitive from a merely economical point of view.

The above aim, as well as the objects referred to and others which will become apparent hereinafter, are achieved by a ski boot with a mechanism for securing the foot instep and heel, according to the invention, which comprises, within the shell of a ski boot, a tension element connected to a traction device accessible from the outside of said boot, characterized in that said tension element defines a rear section rearwardly encircling the area of the heel and associated with a band section extending transversely above a foot instep presser, said band section being, at one of its ends, associated to said boot in the area of the sole of the skier's foot.

BRIEF DESCRIPTION OF THE DRAWING

Further advantages and characteristics will become apparent from the following detailed description of a ski boot with a device for securing the foot instep and heel, which is illustrated, by way of example only, in the accompanying drawing, in which the single drawing FIGURE represents a ski boot with the device applied thereto, according to the invention.

DESCRIPTION OF A PREFERRED EMBODIMENT

With reference to the single drawing figure, a ski boot is illustrated, generally indicated with the reference numeral 1, which boot advantageously, but not necessarily, is of the rear-entry type, and comprises a shell 2 to which are pivotably associated, in a manner known per se, a front quarter 3 and a rear quarter 4. The boot 1 has an instep area 2*a*, a heel area 2*b*, a sole area 2*c* and a wedge area 2*d* of the sole 2*e*.

Inside the ski boot is provided a tension element, advantageously consisting of a cable 10, which cable, at one end, is connected to a traction mechanism or device which can consist of a reel 11, such as is illustrated in the drawing, or, if required, by a lever or any other mechanism capable of exerting the required traction on cable 10.

The cable 10 has an initial section 10*a* connected to the reel 11, which unwinds on a first transmission element composed of a small pulley 20, which pulley is generally provided substantially at the rear lateral area of the shell.

After the initial section 10*a*, the cable 10 defines a first lateral section 10*b*, to which a front section 10*c* follows, which unwinds above presser 21, substantially at the top part of the foot instep presser 21. The instep presser has a first upper zone 21*a* and a second lower zone 21*b*.

After the front section 10*c*, the cable 10 defines a second lateral section 10*d*, which section is opposite with respect to the first lateral section 10*b*, and unwinds on a second transmission element 22, which can consist, for example, of the front quarter 3 hinge means.

The cable then defines a rear section 10*e* which develops from said second lateral section 10*d* and rearwardly encircles the area of the heel and, by means of the interposition of a third transmission device 23, which is essentially opposite to the second transmission device 22, is associated with a terminal section at a beginning portion 10*g* thereof and which can consist of the cable itself or by a band section 10*f* which extends transversely above the foot instep presser,in a zone which is inferior with respect to the engagement zone of the front part 10*c* of the cable, thus obtaining an action on the foot instep presser in two areas remote from each other.

An important peculiarity of the invention is constituted by the fact that the band element defines an increasing useful width, starting from the connection area 10*g* to the rear section 10*e*, towards the opposite end or ending portion 10*e*, where the band element is fixed to the boot substantially at the area wedge area 21 of the sole of the skier's foot.

The band element is preferably made of flexible plastic material, in order to adapt to the configuration of the part of the foot upon which it acts. Furthermore, the band element acts above the presser in rigid material so as to uniformly distribute the load on the foot instep.

At its terminal end, which is the widest end, the band element can be fixed to the wedge provided inside the boot or, if required, is fixed directly to the shell, so that in both solutions it is located substantially at the area of the sole, in such a manner that it encircles, even laterally, the skier's foot.

With this configuration, the forefoot is practically completely embraced, thus exerting a pressure action which is not only vertical, but is also capable of restraining the foot even laterally, thus contributing to a perfect securing of the foot, together with the fact that the cable also engages substantially at the heel area, performing a complete and uniformly distributed securing.

The use of the device is extremely simple; in fact, if cable 10 is put under tension, by means of the transmissions described above, a securing action is performed simultaneously on the forefoot and on the upper part of the foot instep, combined with a securing action on the foot exerted in the area of the heel, where, if required, it is possible to provide a rigid heel element or another element capable of distributing the pressure exerted on the cable substantially proximate to the heel area.

From the above description, it can be seen that the invention achieves the proposed objects, and in particular the fact is stressed that the presence of the band element encircling the foot allows for a perfect securing action without generating excessive forces, which may be a source of discomfort to the user, together with an action on the foot instep presser, which is carried out in two separate areas.

In practice, the materials employed, so long as compatible with the specific use, as well as the dimensions and the contingent shapes, may be any according to the requirements.

What is claimed is:

1. Ski boot with a device for securing the foot instep and heel, the ski boot comprising a shell, at least one quarter connected to said shell, a traction device accessible from the outside of said boot, within said ski boot a foot instep presser having a longitudinal extension, a tension element connected to said traction device, wherein said tension element defines a front section, a rear section, a terminal section, said front section extending transversely above said foot instep presser and connected to said rear section, said rear section rearwardly encircling an area of the heel of the foot and associated to said terminal section, said terminal section extending transversely above said foot instep presser and fixed to said boot substantially at an area of the sole of the skier's foot, said front section and said terminal section engaging with said presser in two areas separated with respect to each other along the longitudinal extension of said presser.

2. Ski boot with a device for securing the foot instep and heel, according to claim 1, wherein said terminal section consists of a band-type section connected, at one end, to said rear section of said tension element and, at the other end, to said boot.

3. Ski boot according to claim 2, further comprising a wedge formation located inside the boot and wherein said band-type section, at said other end, is fixed to said wedge.

4. Ski boot with a device for securing the foot instep and heel, according to the claim 2, wherein said band-type section, at said other end, is fixed to the shell of said boot.

5. Ski boot with a device for securing the foot instep and heel, according to claim 2, wherein said band-type section is made of a flexible material.

6. Ski boot with a device for securing the foot instep and heel, according to claim 2, wherein said band-type section defines an increasing width starting from an area of connection with said rear section towards said other end connected to the boot.

7. Ski boot with a device for securing the foot instep and heel, according to claim 1, wherein said traction device is supported by the rear quarter of the ski boot.

8. In a ski boot with a shell, a front and a rear quarter associated with said shell, a heel area within the boot, a sole area within the boot and an instep area within the boot and with an instep presser in said instep area of the boot, said instep presser having a longitudinal extension with a first zone thereof and a second zone thereof longitudinally at a distance from said first zone, a device for securing the instep and the heel of a wearer's foot within said ski boot, comprising a traction mechanism on said boot and accesible from the outside of the boot, a flexible elongated tension element operatively connected to said traction mechanism, said tension element defining a front section thereof extending transversely over said instep presser at said first zone thereof, a rear section thereof connected to said front section and extending within said heel area of the boot to encircle in use the heel of a wearer's foot, a terminal section thereof associated with said rear section and extending transversely over said instep presser at said second zone thereof and fixed to said boot near said sole area thereof.

9. A ski boot according to claim 8, wherein said terminal section of said tension element consists of a band-type section.

10. A ski boot according to claim 8, wherein said band-type section has a progressively increasing width.

11. In a ski boot with a shell, a front and a rear quarter hinged on said shell, a heel area within the boot, a sole area within the boot, a wedge area near said sole area, and an instep area within the boot and with an instep presser in said instep area of the boot, said instep presser having a longitudinal extension with a first zone thereof and a second zone thereof longitudinally at a distance from said first zone, a device for securing the instep and the heel of a wearer's foot within said ski boot, comprising, a traction mechanism on said rear quarter and accesible from the outside of the boot, a cable means operatively connected to said traction mechanism, said cable means comprising in consecutive order, an initial section nearest to said traction mechanism, a first lateral section extending at a side of the instep area, a front section thereof extending transversely over said instep presser at said first zone thereof, a second lateral section extending at another side of said instep area, a rear section of said cable means developing from said second lateral section and extending within said heel area of the boot to encircle in use the heel of a wearer's foot, a terminal section of said cable means, said terminal section having a beginning portion and an ending portion, said beginning portion of said terminal section being connected to said rear section of said cable means and extending transversely over said instep presser at said second zone thereof and said ending portion of said termina section being fixed to said boot near said wedge area thereof, said terminal section being in the form of a band having a width increasing from said beginning portion thereof towards said ending portion thereof to encircle laterally the instep of the wearer's foot beyond said instep presser.

* * * * *